US005144385A

United States Patent [19]

Tani

[11] Patent Number: 5,144,385

[45] Date of Patent: Sep. 1, 1992

[54] CURL REMOVING DEVICE FOR AN IMAGE RECORDER

[75] Inventor: Tatsuo Tani, Urayasu, Japan

[73] Assignee: Ricoh Company, Ltd., Tokyo, Japan

[21] Appl. No.: 799,954

[22] Filed: Nov. 29, 1991

[30] Foreign Application Priority Data

| | | | |
|---|---|---|---|
| Nov. 29, 1990 | [JP] | Japan | 2-332658 |
| Nov. 29, 1990 | [JP] | Japan | 2-332659 |
| Nov. 29, 1990 | [JP] | Japan | 2-332660 |
| Nov. 29, 1990 | [JP] | Japan | 2-332661 |
| Jun. 26, 1991 | [JP] | Japan | 3-154248 |

[51] Int. Cl.[5] ..... G03G 21/00

[52] U.S. Cl. ..... 355/309; 162/271

[58] Field of Search ..... 355/309, 308, 282, 271; 162/270, 271

[56] References Cited

U.S. PATENT DOCUMENTS

| | | | |
|---|---|---|---|
| 4,326,915 | 4/1982 | Mutschler | 162/271 |
| 4,475,896 | 10/1984 | Bains | 162/271 X |
| 4,505,695 | 3/1985 | Billings | 162/271 X |
| 4,539,072 | 9/1985 | Frye et al. | 162/271 X |
| 4,591,259 | 5/1986 | Kuo et al. | 355/309 |
| 4,609,517 | 9/1986 | Cason et al. | 162/271 X |
| 4,627,718 | 12/1986 | Wyer | 355/309 |
| 4,632,533 | 12/1986 | Young | 355/309 |
| 4,652,110 | 3/1987 | Sato et al. | 355/309 |
| 4,977,432 | 12/1990 | Coombs et al. | 355/309 |
| 5,066,984 | 11/1991 | Coombs | 355/309 |

FOREIGN PATENT DOCUMENTS

| | | | |
|---|---|---|---|
| 56-159661 | 12/1981 | Japan | 355/309 |

*Primary Examiner*—Richard L. Moses

*Attorney, Agent, or Firm*—Oblon, Spivak, McClelland, Maier & Neustadt

[57] ABSTRACT

A device incorporated in an image recorder for removing the curl of a recording sheet being transported along a transport path. A rotatable elastic roller is disposed on the transport path at the inner side with respect to the curl of the recording sheet. A rotatable pressing member has a polygonal cross-section and has a plurality of curved portions each having a particular radius of curvature on the periphery thereof. The pressing member is located at the outer side with respect to the direction of curl. The center of rotation of the pressing member is parallel to the center of rotation of the elastic roller. A fixing device fixes the pressing member in a position where one of the curved portions presses against the periphery of the elastic roller.

9 Claims, 12 Drawing Sheets

CURL REMOVING DEVICE FOR AN IMAGE RECORDER

BACKGROUND OF THE INVENTION

The present invention relates to a device incorporated in a copier, facsimile transceiver, printer or similar image recorder for removing the curl of a recording sheet.

A curl removing device for the above application has beem proposed in various forms in the past. For example, Japanese Patent Publication No. 11792/1975 discloses a device having an elastic roller whose surface layer is made of an elastic material such as rubber or sponge, and a hard roller pressed against the elastic roller. A recording sheet with a curl is passed through between the elastic roller and the hard roller with the outer side thereof with respect to the direction of curl facing the hard roller. Since the amount of curl of a recording sheet depends on the material and the moisture content of the sheet. the force to act on the sheet for straightening it has to be changed in matching relation to the amount of curl. The conventional curl removing devices including the device disclosed in the above-mentioned Japanese Patent Publication cannot meet this requirement. Specifically, it is likely with the conventional devices that a recording sheet with a noticeable curl fails to have the curl removed sufficiently while a recording sheet with a small curl is caused to curl in the other direction.

SUMMARY OF THE INVENTION

It is, therefore, an object of the present invention to provide a curl removing device for an image recorder which performs a straightening operation matching the amount of curl of a recording sheet.

A device incorporated in an image recorder for removing the curl of a recording sheet of the present invention has a rotatable elastic roller disposed on a transport path defined in the image recorder for transporting the recording sheet. The elastic roller is located at the inner side with respect to the direction of the curl of the sheet. A rotatable pressing member has a center of rotation parallel to the center of rotation of the elastic roller and is located at the outer side with respect to the direction of the curl. The pressing member has a polygonal cross-section and a plurality of curved portions each having a particular radius of curvature on the periphery thereof. A fixing device fixes the pressing in a position where any one of the curved portions presses against the periphery of the elastic roller.

The center of rotation of the pressing member may be deviated from the position where one of the curved portions presses against the elastic roller toward the upstream side with respect to the intended direction of sheet transport.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
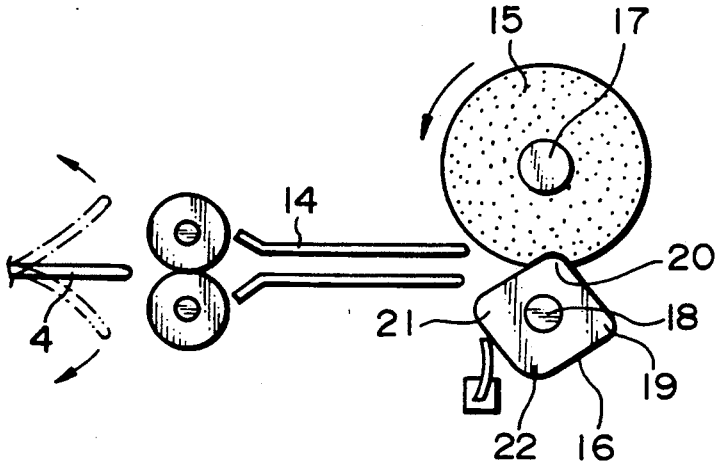
FIG. 1 is a front view showing a first embodiment of curl removing device in accordance with the present invention.

Referring to FIGS. 1–6, a first embodiment of the curl removing device in accordance with the present invention is shown. First, a reference will be made to FIG. 6 for describing an image recorder to which the illustrative embodiment, as well as the other embodiments to follow, is applicable. As shown, the image recorder is implemented as a copier by way of example and has a body 1 and an automatic document feeder (ADF) 2 mounted on the body 1. Arranged in the copier body 1 are a photoconductive drum 3, sheet trays 5, 6 and 7 each being loaded with a stack of recording sheets 4, a charger 8 for uniformly charging the surface of the drum 3, a developing unit 9 for developing a latent image electrostatically formed on the charged surface of the drum 3 by optics, not shown, a corona discharger 10 for transferring the developed image or toner image to the sheet 4, and a corona discharge 11 for separating the sheet 4 from the drum 3. Also accommodated in the copier body 1 are a belt 13 for transporting the recording sheet 4 separated from the drum 3 to a fixing station 12, and a transport path 14 for selectively transporting the sheet 4 coming out of the fixing station 12 to an intermediate or two-side tray 13*a*, or a sorter, not shown, and a stapler, not shown.

Figure 2:
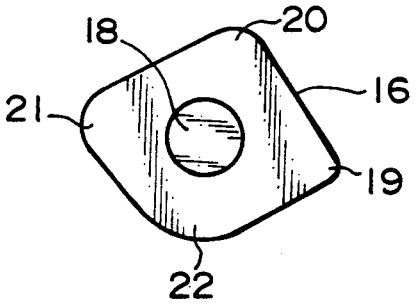
FIG. 2 is an enlarged front view of a pressing member included in the first embodiment.

An elastic roller 15 and a pressing member 16 are located to face each other with the intermediary of the transport path 14. The elastic roller 15 is driven by a motor, not shown. In the illustrative embodiment, these roller 15 and pressing member 16 constitute the curl removing device. The surface portion of the roller 15 is made of rubber, sponge or similar elastic material. As shown in FIGS. 1 and 2, the pressing member 16 has a generally square cross-section and is mounted on a rotatable shaft 18 which is parallel to a rotatable shaft 17 mounting the roller 15 thereon. The four corners of the pressing member 16 are rounded to form curved portions 19, 20, 1 and 22 each having a particular radius of curvature. For example, the curved portions 19, 20, 21 and 22 have radii of curvatures of 0.3 millimeter, 1 millimeter, 5 millimeters, and 20 millimeters, respectively. The roller 15 and the pressing member 16 are spaced apart from each other such that the curved portions 19–22 each presses against the periphery of the roller 15 when located to face the roller 15. Further, the roller 15 and the pressing member 16 are positioned at the inner side and the outer side, respectively, with respect to the direction in which the sheet 4 is curled.

Figure 3:
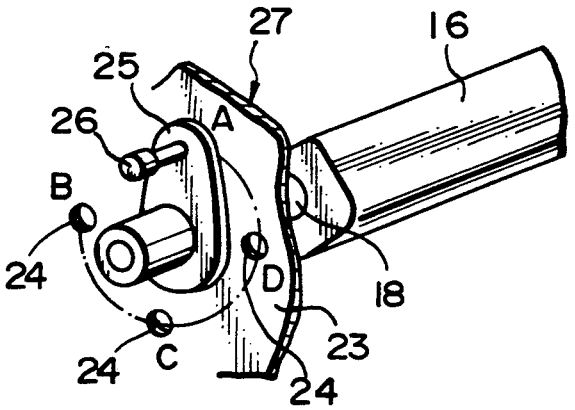
FIG. 3 is a perspective view showing an arrangement for supporting the pressing member.

As shown in FIG. 3, the shaft 18 of the pressing member 16 is journalled to a side wall 23 of a frame. Four holes 24 are formed through the side wall 23 on the same circle whose center is defined by the shaft 18. An arm 25 is affixed to the shaft 18. A pin 26 is studded on the arm 25 to mate with any one of the holes 24. The arm 25, pin 26, side wall 23 and holes 24 constitute in combination a fixing device 27 for fixing the pressing member in a particular position where any one of the curved portions 19–22 presses against the roller 15.

In the above configuration, the pin 26 is inserted in any one of the holes 24 to fix the position of the pressing member 16. At this instant, as shown FIG. 1, one of the curved portions 19–22 is held in pressing contact with the periphery of the elastic roller 15. Thereafter, the roller 15 is driven to rotate in a direction for transporting the sheet 4. While the sheet 4 being curled is passed through between the roller 15 and the pressing member 16, it has the inner side and the outer side thereof with respect to the direction of the curl pressed by the roller 15 and one of the curved portions 19–22, respectively. As a result, a force tending to bend the recording sheet 4 in the opposite direction to the direction of the curl acts on the sheet 4 to thereby remove the curl.

The force tending to bent the sheet 4 in the above-mentioned direction increases with the decrease in the radius of curvature of the curved portion (19–22) that presses against the elastic roller 15. Hence, one of the curved portions 19–22 pressing against the roller 15 is replaced with another in matching relation to the amount of curl of the sheet 4. To press particular one of the curved portions 19–22 against the roller 15, the pin 26 is pulled out from the hole 24, then the pressing member 16 is rotated, and then the pin 26 is inserted into another hole 24 after the member 16 has reached a desired position. This is successful in sufficiently removing the curl of the sheet 4 and in preventing the sheet 4 from being curled in the other direction.

Figure 4:
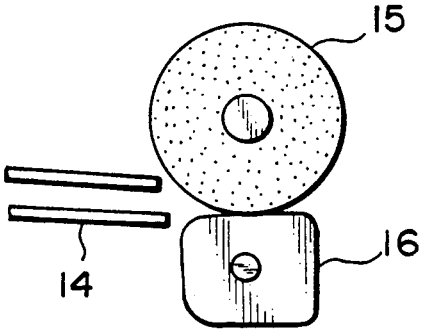
FIG. 4 is a front view showing the pressing member positioned such that a flat portion thereof faces an elastic roller.
Figure 5:
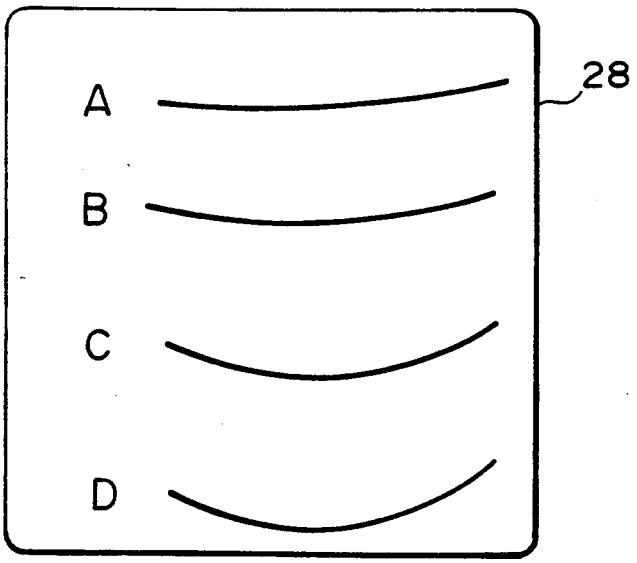
FIG. 5 is a front view of a display panel indicating specific amounts of curl to be used for determining the amount of curl of a recording sheet.
Figure 6:
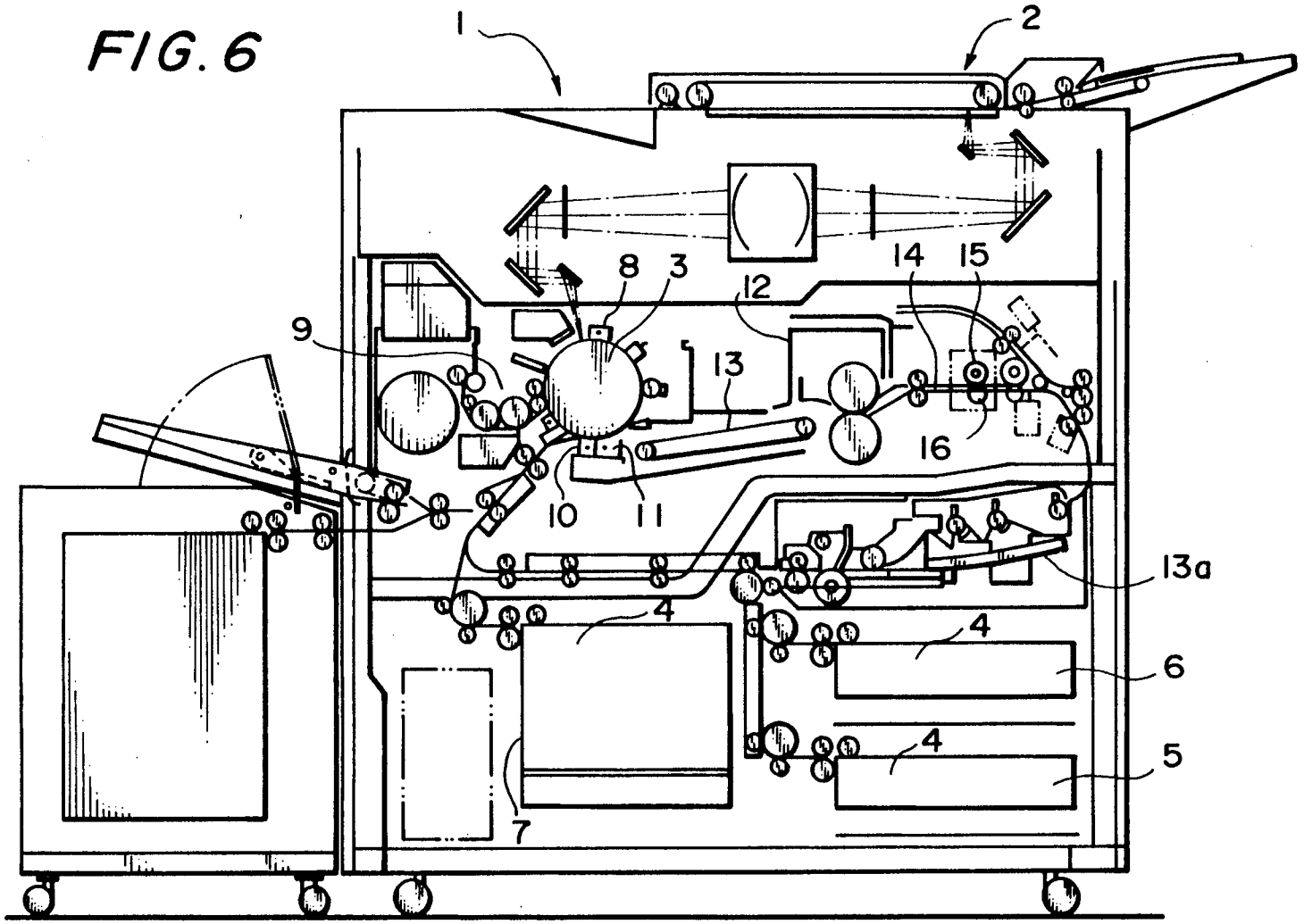
FIG. 6 is a section of a copier to which the present invention is applicable.

FIG. 4 shows the pressing member 16 in a particular position for determining the amount of curl of the sheet 4 beforehand. While a flat portion of the pressing member 16 faces the elastic roller 15 as shown in FIG. 4, the sheet 4 is fed out without having the curl thereof removed. Then, the resulting curl of the sheet 4 is compared with various amounts of curl which are shown in FIG. 5 specifically and displayed on a display panel 28. The pin 26 is inserted into one of the holes 24 whose label corresponds to one of the labels A, B, C and D provided on the display panel 28.

Figure 7:
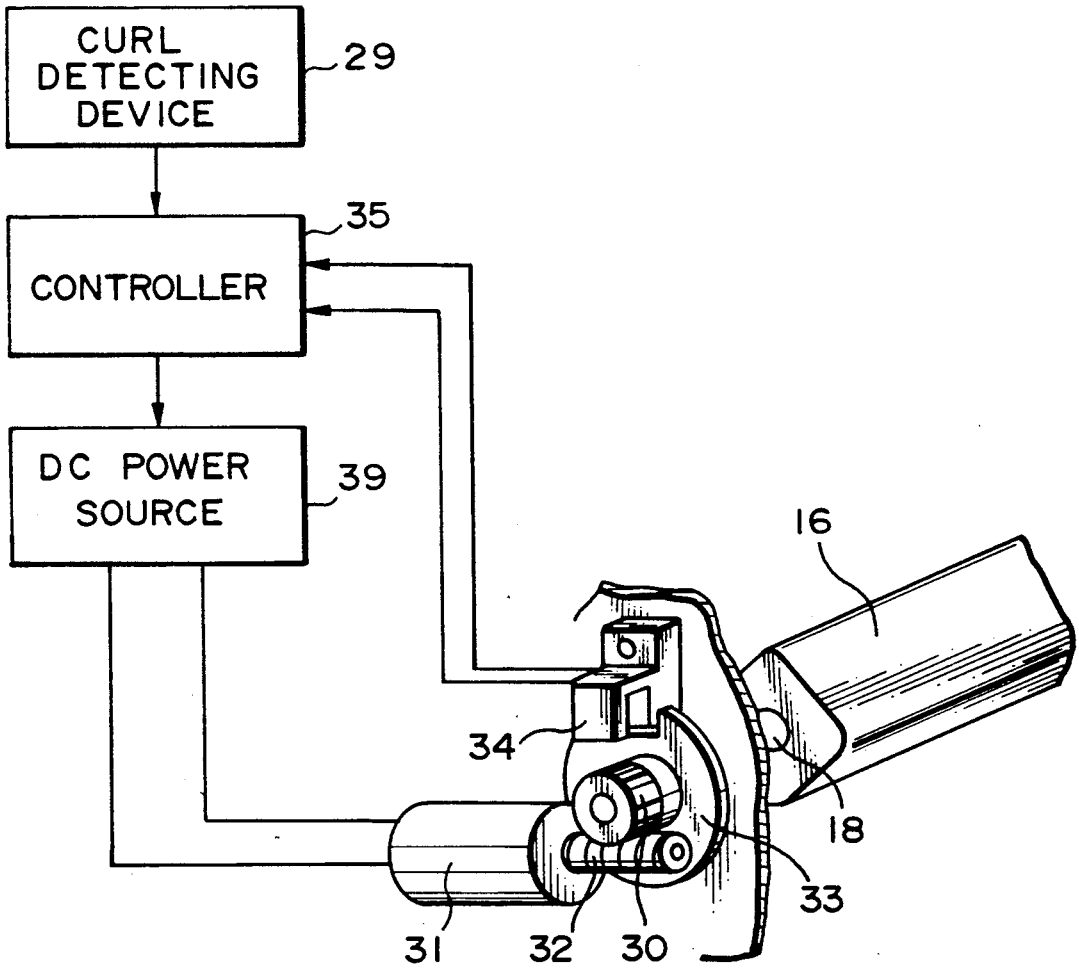
FIG. 7 is a block diagram schematically showing a second embodiment of the present invention.

Referring to FIG. 7, a second embodiment of the present invention will be described. In the figures, the same parts or structural elements are designated by like reference numerals, and redundant description will be avoided for simplicity. This is also true with the other embodiments which will be described. A curl detecting device 29 is disposed on the transport path 14, FIG. 6, upstream of the elastic roller 15 and pressing member 16 with respect to the intended direction of sheet transport. The curl detecting device 29 determines the amount of curl of the recording sheet 4. A gear affixed to the shaft 18 of the pressing member 16 and held in mesh with a gear 32 which is connected to a driver or motor 31. An actuator 33 is rotatable integrally with the pressing member 16 and is formed with a recess. A sensor 34 senses the position of the actuator 33 in the direction of rotation of the latter. A controller 35 controllably drives the motor 31 in response to the outputs of the sensor 34 and curl detecting device 29. A DC power source 39 is connected between the controller 35 and the motor 31.

In operation, the curl detecting device 29 determines the amount of curl of the sheet 4 having moved away from the fixing station 12. The controller 35 drives the motor 31 in response to the resulting output of the curl detecting device 29 and the output of the sensor 34. As a result, the pressing member 16 is rotated until one of the curved portions 19–22 which matches the amount of curl presses against the elastic roller 15. In such a position, the pressing member 16 is fixed in place. In this manner, the embodiment automatically removes the curl of the sheet 4 without relying on the determination of the amount of curl by eye or the manual adjustment of the pressing member 16. The motor 31 and controller 35 also serve as a device for fixing the roller 15 in a particular position where adequate one of the curve portions 19–22 contacts the roller 15.

While the embodiment drives the motor 31 by the controller 35, the operator may drive the motor 31 on the basis of detected curl information to bring the pressing member 16 to an adequate position as mentioned above.

Figure 8A:
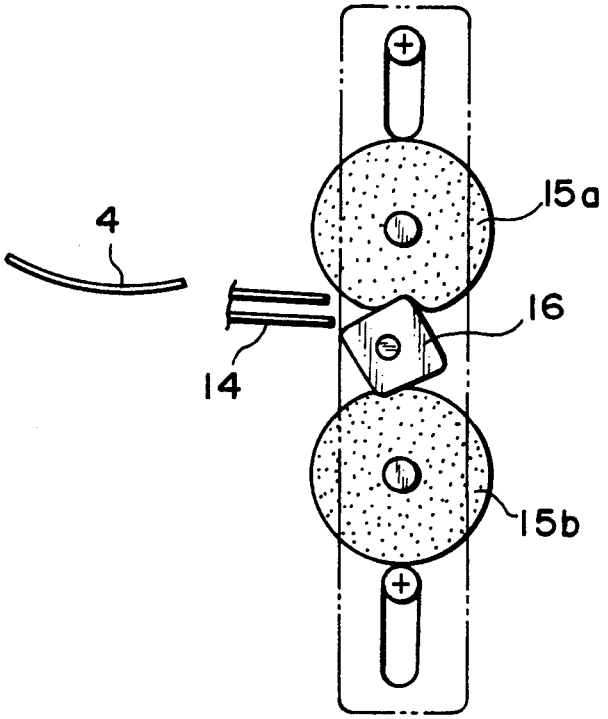
FIGS. 8A and 8B are front views showing a modification of the first or second embodiment.
Figure 8B:
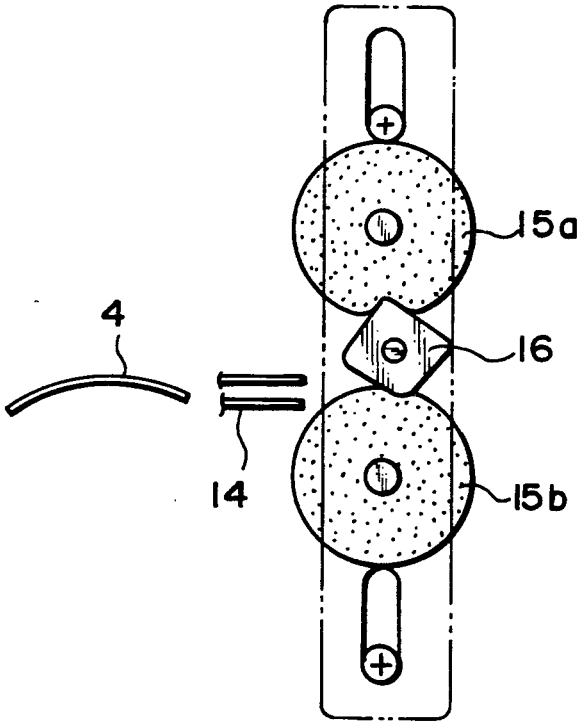

FIGS. 8A and 8B show a modification of the first or second embodiment described above. As shown, a pair of elastic rollers **15*a* and 15*b* are located at opposite sides of the pressing member 16. The rollers 15*a* and 15*b* and pressing member 16 are bodily movable in a direction perpendicular to the transport path 14, so that either of the rollers 15*a* and 15*b* may be used in matching relation to the direction in which the sheet 4 is curled. As shown in FIG. 8A, when the sheet 4 is curled upward, the sheet 4 is passed through between the roller 15*a* and the pressing member 16 to remove the curl. As shown in FIG. 8B, when the sheet 4 is curled downward, it is passed through between the other roller 15*b* and the pressing member 16 to remove the curl. The modification, therefore, successfully removes the curl of the sheet 4** with no regard to the direction of the curl.

Figure 9:
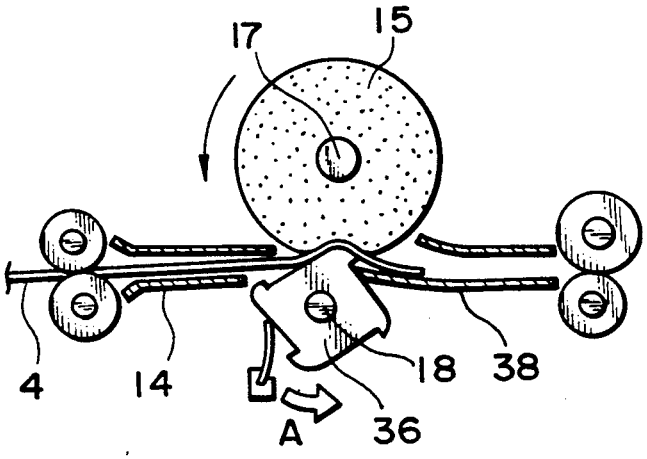
FIG. 9 is a front view showing a third embodiment of the present invention.
Figure 10:
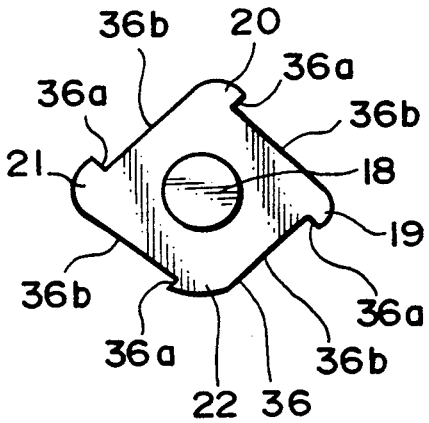
FIG. 10 is an enlarged front view of a pressing member included in the third embodiment.
Figure 11:
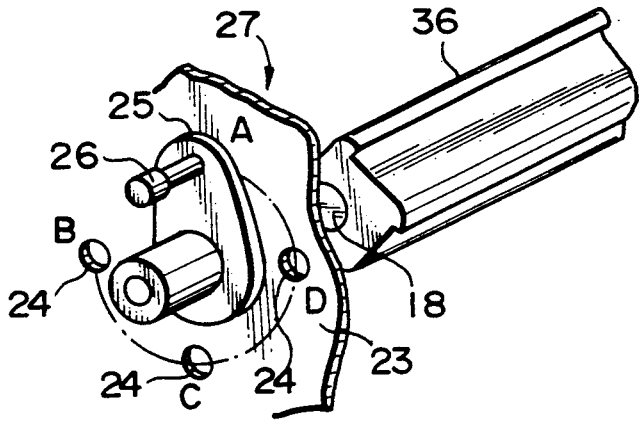
FIG. 11 is a perspective view showing an arrangement for supporting the pressing member of FIG. 10.
Figure 12:
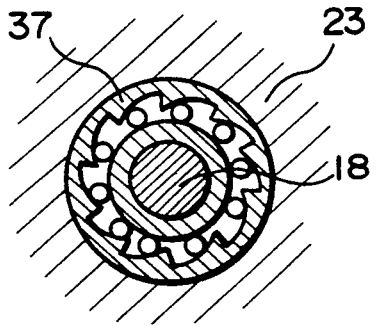
FIG. 12 is a sectional front view of a one-way clutch included in the third embodiment.
Figure 13:
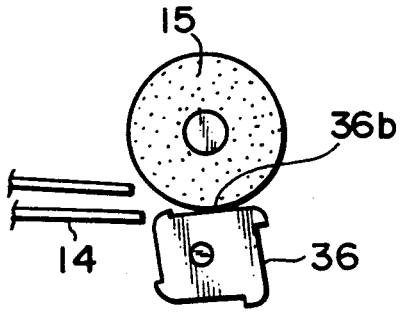
FIG. 13 is a front view showing a pressuring member included in the third embodiment in a condition wherein a flat surface thereof faces an elastic roller.

A reference will be made to FIG. 9–13 for describing a third embodiment of the present invention. The elastic roller 15 and a pressing member 36 are located to face each other with the intermediary of the transport path 14. The pressing member 36 has a generally square cross-section and is mounted on the shaft 18 which is parallel to the shaft 17 of the elastic roller 15. The pressing member 36, like the pressing member 16 shown in FIG. 1 or 2, is provided with the curved portions 19–22 each having a particular radius of curvature. The roller 15 and the pressing member 36 are spaced apart such that the curved portions 19–22 each presses against the roller 15 when brought to a position where it faces the roller 15. The roller 15 and the pressing member 36 are located at the inner side and the outer side, respectively, with respect to the direction of curl of the sheet 4. A rotation limiting device which will be described allows the pressing member 36 to rotate only in the opposite direction to the transport direction, as indicated by an arrow A in FIG. 9. The rear end of each of the curved portions 19–22 with respect to the direction A merges into a recess or shoulder 36. The rear end of the shoulder 36 in turn merges into a flat portion **36*b* which extends to the next curved portion. As shown in FIG. 11, the shaft 18 is journalled to the frame side wall 23. The frame side wall, the four holes 24 formed in the side walls 23, the arm 25 affixed to the shaft 18, and the pin 26 studded on the arm 25 constitute the fixing device 27. As shown in FIG. 12, the rotation limiting device is implemented as a one-way clutch 37 which is interposed between the shaft 18 and the side wall 23. Further, as shown in FIG. 9, an elastic guide 38 is located at a position downstream of the pressing member 36 and elastic roller 15 and in close proximity to the shoulder 36*a* of the flat portion 36*b***.

In the above configuration, the pin 26 is inserted in any one of the holes 24 to fix the position of the pressing member 16. At this instant, as shown in FIG. 9, one of the curved portions 19–22 is held in pressing contact with the periphery of the elastic roller 15. Thereafter, the roller 15 is rotated in a direction for transporting the sheet 4. While the recording sheet 4 having a curl is passed through between the roller 15 and the pressing member 16, it has the inner side and the outer side thereof with respect to the direction of the curl pressed by the roller 15 and one of the curved portions 19–22, respectively. As a result, a force tending to bend the sheet 4 in the opposite direction to the direction of the curl acts on the sheet 4 to thereby remove the curl. The force tending to bent the sheet 4 in the above-mentioned direction increases with the decrease in the radius of curvature of the curved portion (19–22) that presses against the elastic roller 15, as stated earlier. Hence, one of the curved portions 19–22 pressing against the roller 15 is replaced with another matching the amount of curl of the sheet. To press particular one of the curved portions 19–22 against the roller 15, the pin 26 is pulled out from the hole 24, then the pressing member 36 is rotated, and then the pin 26 is inserted into another hole 24 after the member 36 has reached a desired position. This is successful in sufficiently removing the curl of the sheet 4 and in preventing the sheet 4 from being curled in the other direction.

To determine the amount of curl of the sheet 4, the pressing member 36 is positioned such that one of the flat portions **36*b* thereof faces the elastic roller 15. In this condition, the sheet 4 is fed out without having the curl thereof removed. This is followed by the procedure described with reference to FIG. 5**.

The sheet 4 moved away from the pressing member 36 and elastic roller 15 is transported while being bent toward the pressing member 36. Since the free edge of the elastic guide 38 is held in contact with the flat portion **36*b* of the pressing member 36, the sheet 4 is prevented from being caught by the guide 38 to jam the transport path 14. In addition, at the inlet side of the pressing member 36 and roller 15, the flat portion 36*b* of the member 36 plays the role of a guide, so that the sheet 4 is smoothly fed to between the member 36 and the roller 15. The one-way clutch 37 prevents the pressing member 36 from rotating in the direction of sheet transport. Hence, when one of the curved portions 19–22 contacting the roller 15 should be replaced with another, the pressing member 36 is inhibited from rotating in the direction of the sheet transport; should it be rotated in such a direction, the free edge of the guide 38 would bite into the shoulder 36*a* and thereby damage the guide 38**.

Figure 14:
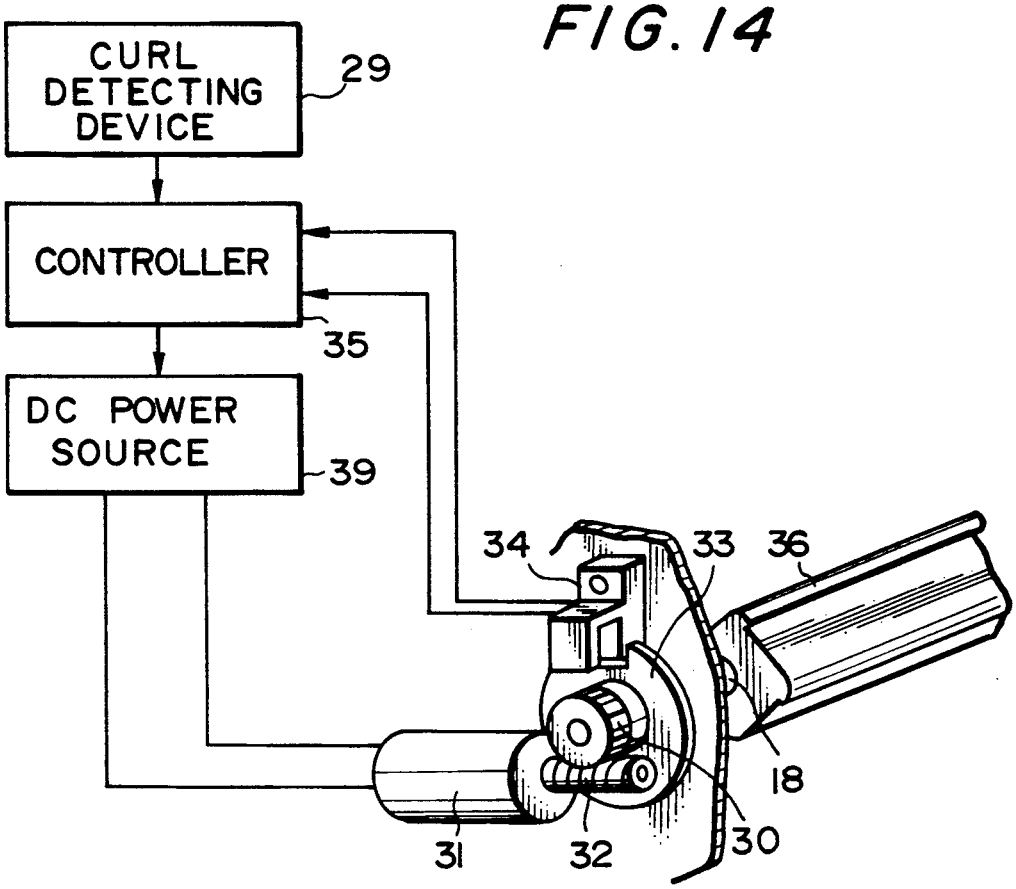
FIG. 14 is a block diagram schematically showing a fourth embodiment of the present invention.

A fourth embodiment of the present invention will be described with reference to FIG. 14. As shown, this embodiment is essentially similar to the second embodiment shown in FIG. 7 except that the pressing member 36 is substituted for the pressing member 16 and that the controller 35 plays the role of a rotation limiting device. The controller 35 also serves as a fixing device for fixing the pressing member 36 in a particular position, as stated earlier. The controller 35 drives the motor 31 in response to the output of the curl detecting device 29 and the output of the sensor 34, whereby the pressing member 36 is rotated to an adequate position in the same manner as in the second embodiment. This embodiment also automatically removes the curl of the sheet 4 without relying on the determination of the amount of curl by eye or the manual adjustment of the pressing member 36. In addition, the controller 35 inhibits the pressing member 36 from rotating in the direction of transport; should it be rotated in such a direction, the free edge of the guide 38 would bite into the shoulder **36*a* and thereby damage the guide 38**.

Figure 15:
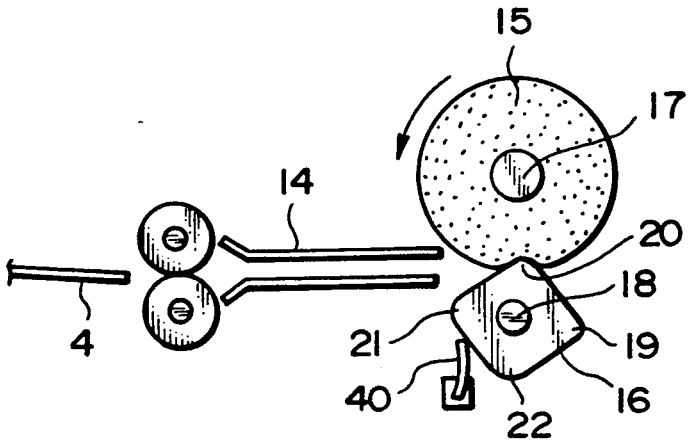
FIG. 15 is a front view showing a fifth embodiment of the present invention.
Figure 16:
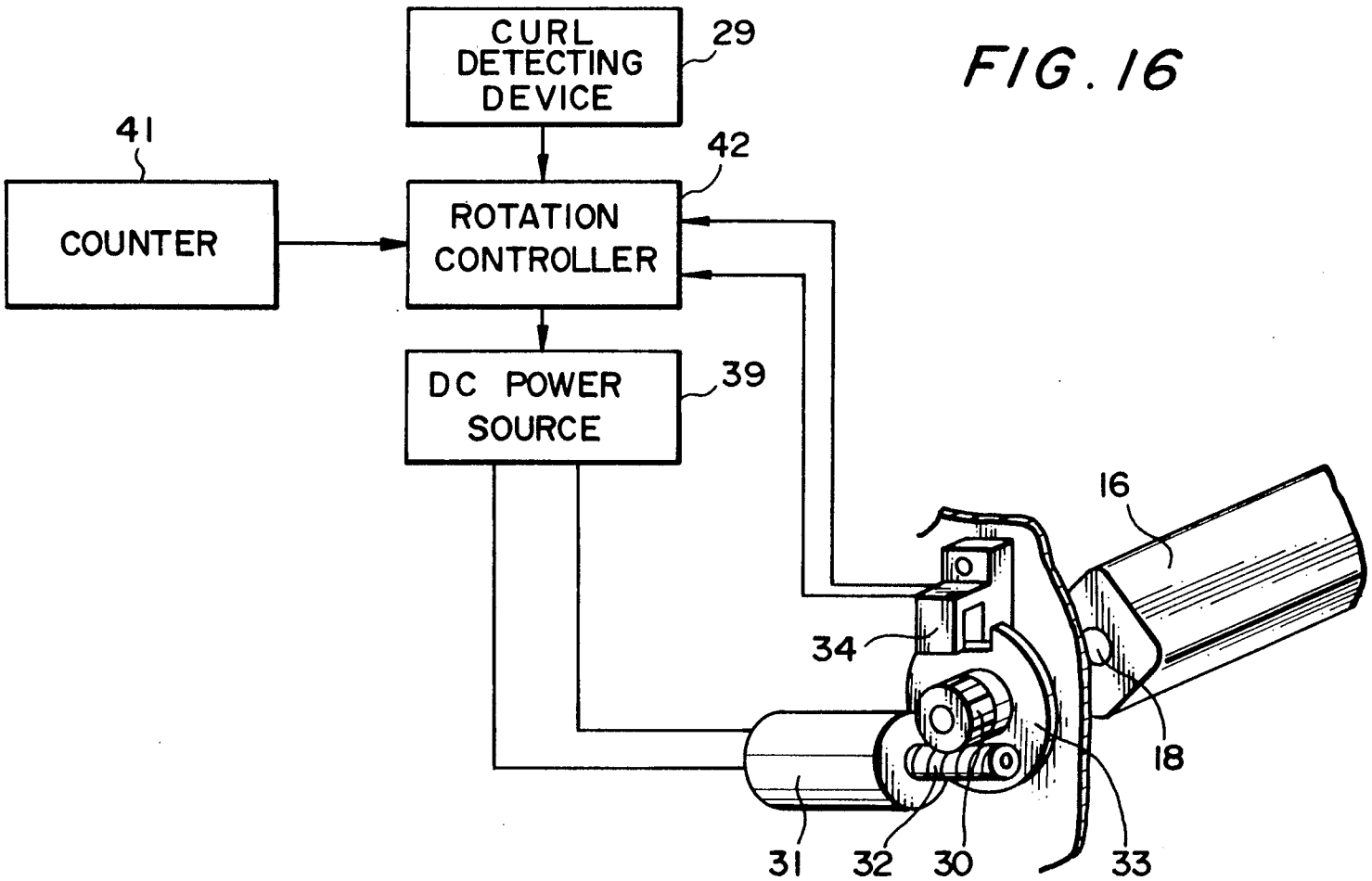
FIG. 16 is a block diagram schematically showing a control system associated with a pressing member included in the fifth embodiment.
Figure 17:
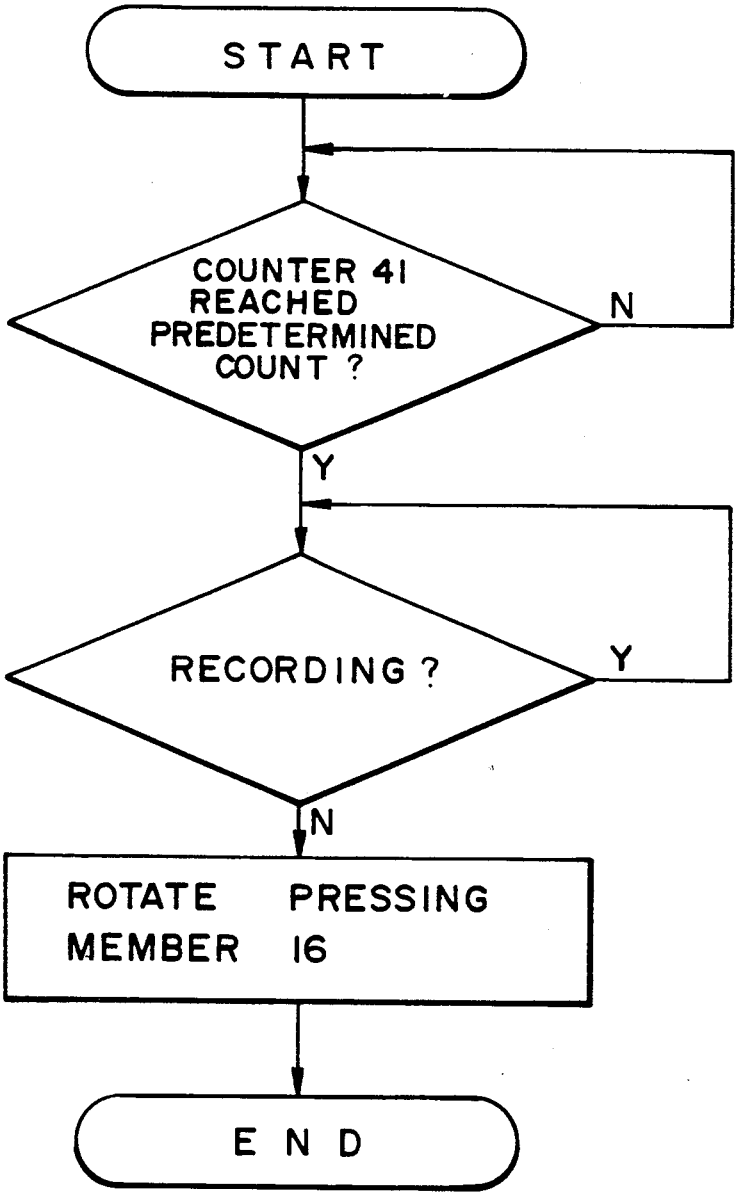
FIG. 17 is a flowchart demonstrating a specific operation of the control system shown in FIG. 16.

Referring to FIGS. 15–17, a fifth embodiment of the curl removing device in accordance with the present invention is shown. The elastic roller 15 and the pressing member 16 are located to face each other with the intermediary of the transport path 14. The pressing member 16 is identical with the pressing member 16 shown in FIG. 2, i.e., it has a generally square cross-section and is mounted on the shaft 18 which is parallel to the shaft 17 mounting the elastic roller 15 thereon. The four corners of the pressing member 16 are rounded to form the curved portions 19, 20, 21 and 22 each having a particular radius of curvature. The roller 15 and the pressing member 16 are spaced apart from each other such that the curved portions 19–22 each presses against the periphery of the roller 15 when located to face the roller 15. Further, the roller 15 and the pressing member 16 are positioned at the inner side and the outer side, respectively, with respect to the direction in which the sheet 4 is curled. A cleaning blade 40 is held in contact with the periphery of the pressing member 16 to serve as a cleaning member.

The curl detecting device 29 is disposed on the transport path 14 upstream of the elastic roller 15 and pressing member 16 with respect to the direction of sheet transport. The curl detecting device 29 determines the amount of curl of the sheet 4. The gear 30 is afixxed to the shaft 18 of the pressing member 16 and held in mesh with the gear 32 which is connected to the motor 31. The actuator 33 is rotatable integrally with the pressing member 16 and is formed with a recess. The sensor 34 senses the position of the actuator 33 in the direction of rotation of the latter. A rotation controller 42 controllably drives the motor 31 in response to the outputs of the sensor 34 and curl detecting device 29. Further, the rotation controller 42 drives the motor 31 in response to the output of a counter 41 which counts recording sheets 4 undergone the recording procedure. The rotation controller 42 and motor 31 also serves as a fixing device for fixing the pressing member 16 in a position where one of the curved portions 19–22 presses against the elastic roller 15. The periphery of the pressing member 16 is coated with Teflon which functions to reduce surface energy.

On the start of a copying operation, the curl detecting device 29 determines the amount of curl of the recording sheet 4 having moved away from the fixing station 12. The rotation controller 42 drives the motor 31 in response to the outputs of the curl detecting device 29 and sensor 34. As a result, the pressing member is rotated to such a position that one of the curved portions 19–22 matching the detected amount of curve presses against the elastic roller 15. This eliminates the need for the determination of the amount of curl by eye or the manual adjustment of the pressing member 16. While the sheet 4 with a curl is passed through between the roller 15 and the pressing member 16, it has the inner side and the outer side thereof with respect to the direction of the curl pressed by the roller 15 and one of the curved portions 19–22, respectively. As a result, a force tending to bend the sheet 4 in the opposite direction to the direction of the curl acts on the sheet 4 to thereby remove the curl. The force tending to bent the sheet 4 in the above-mentioned direction increases with the decrease in the radius of curvature of the curved portion (19–22) that presses against the elastic roller 15, as stated earlier. Hence, one of the curved portions 19–22 pressing against the roller 15 is replaced with another matching the amount of curl of the sheet by the rotation controller 42. This is successful in sufficiently removing the curl of the sheet 4 and in preventing the sheet 4 from being curled in the other direction. The counter 41 counts the sheets 4 having undergone the copying procedure one after another. As shown in FIG. 17, when the counter 41 reaches a predetermined count, whether or not a recording operation is under way is determined. As soon as the recording operation is interrupted, the rotation controller 42 drives the motor 31 to rotate the pressing member 16. At this instant, the cleaning blade 40 held in contact with the pressing member 16 removes toner particles and paper dust from the surface of the pressing member 16. The Teflon coating provided on the pressing member 16 not only allows a minimum of toner particles and paper dust to deposit on the pressing member 16 but also promotes the removal by the cleaning blade 40.

Figure 18:
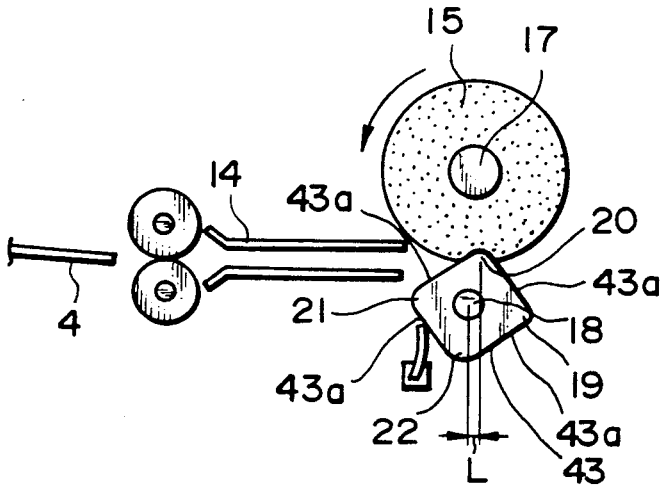
FIG. 18 is a front view showing a sixth embodiment of the present invention.
Figure 19:
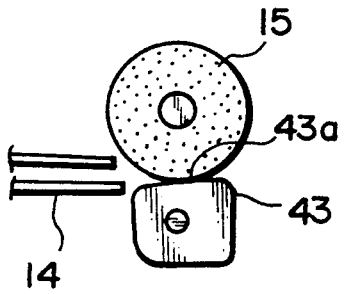
FIG. 19 is a front view showing a pressingg member included in the sixth embodiment in a condition wherein a flat portion thereof faces an elastic roller.

FIGS. 18 and 19 show a sixth embodiment of the present invention. As shown, the elastic roller 15 and a pressing member 43 are located to face each other with the intermediary of the transport path 14. The pressing member 43 is identical with the pressing member 16 shown in FIG. 2, i.e., it has a generally square cross-section and is mounted on the shaft 18 which is parallel to the shaft 17 mounting the roller 15 thereon. The four corners of the pressing member 43 are rounded to form the curved portions 19, 20, 21 and 22 each having a particular radius of curvature. The roller 15 and the pressing member 43 are spaced apart from each other such that the curved portions 19–22 each presses against the periphery of the roller 15 when located to face the roller 15. Further, the roller 15 and the pressing member 43 are positioned at the inner side and the outer side, respectively, with respect to the direction in which the sheet 4 is curled. Nearby ones of the curved portions 19 and 22 are connected to each other by a flat portion **43*a*. After one of the curved portions 19–22 of the pressing member 43 has been pressed against the roller 15, the member 43 is fixed in place by the fixing device 27, FIG.3. The pressing member 43 is positioned such that the shaft 18 thereof is deviated from the position where one of the curved portions 19–22 contacts the roller 15** by a distance L toward the upstream side in the intended direction of sheet transport.

In the above configuration, the pressing member 43 is fixed in place by the fixing device 27. In this condition, one of the curved portions 19–22 presses against the elastic roller 15. Thereafter, the roller 15 is rotated in the direction of sheet transport. While the sheet 4 with a curl is passed through between the roller 15 and the pressing member 16, it has the inner side and the outer side thereof with respect to the direction of the curl pressed by the roller 15 and one of the curved portions 19–22, respectively. As a result, a force tending to bend the sheet 4 in the opposite direction to the direction of the curl acts on the sheet 4 to thereby remove the curl. The force tending to bent the sheet 4 in the above-mentioned direction increases with the decrease in the radius of curvature of the curved portion (19–22) that presses against the elastic roller 15, as stated earlier. Hence, one of the curved portions 19–22 pressing against the roller 15 is replaced with another matching the amount of curl of the sheet. To change the curved portion that contacts the roller 15, the pin 26 is pulled out from the hole 24, then the pressing member 16 is rotated, and then the pin 26 is inserted into another hole 24 when the member 16 is brought to an expected position. This sufficiently removes the curl of the sheet 4 and presents the sheet 4 from being curled in the other direction.

To determine the amount of curl of the sheet 4, the pressing member 36 is position such that one of the flat portions **36*b* thereof faces the elastic roller 15, as shown in FIG. 19. In this condition, the sheet 4 is fed out without having the curl thereof removed. This is followed by the procedure described with reference to FIG. 5**.

The shaft 18 of the pressing member 43 is deviated from the point of contact of curved portion of the member 43 and the roller 15 by the distance L, as stated above. Hence, the flat portion **43*a* plays the role of a guide for the sheet 4 being transported toward the position where the curved portion and the roller 15 contact each other, whereby the sheet 4 is smoothly fed to between the curved portion and the roller 15**.

In the above embodiment, the amount of curl of the sheet 4 is determined by eye, and one of the curved portions 19–22 matching the amount of curl is brought into contact with the roller 15 by hand. Alternatively, as shown in FIG. 7, the controller 35 may drive the motor 31 in response to the output of the curl detecting device 29 until the pressing member 43 reaches an adequate position.

Figure 20A:
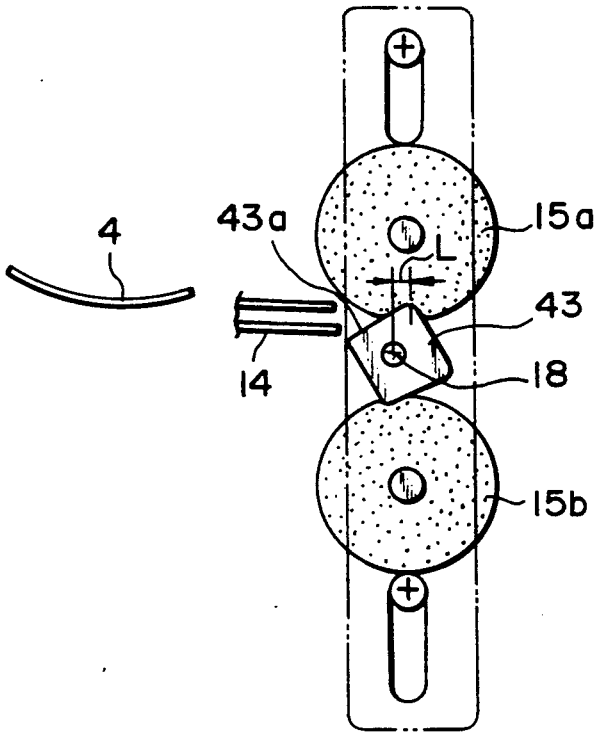
FIGS. 20A and 20B are front views showing a seventh embodiment of the present invention.
Figure 20B:
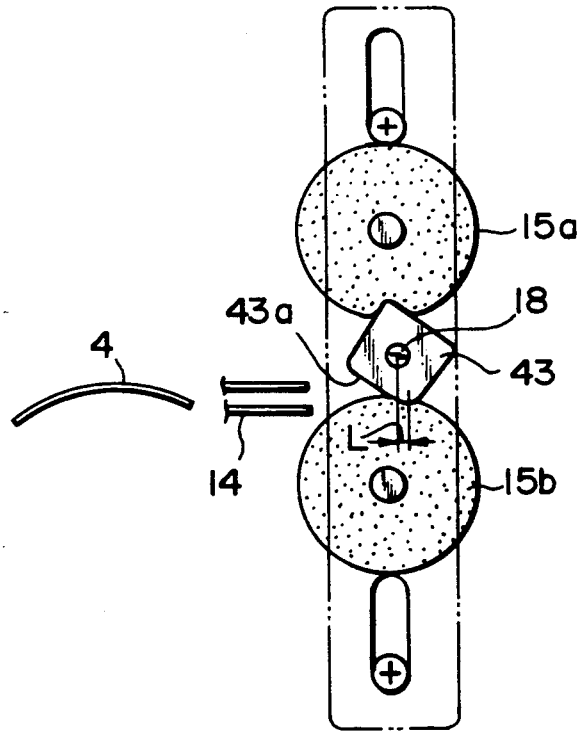

FIGS. 20A and 20B show a seventh embodiment of the present invention. As shown, the elastic rollers **15*a* and 15*b* are located at opposite sides of the pressing member 43, and each is driven in the direction of sheet transport. The rollers 15*a* and 15*b* and the pressing member 43 are spaced apart from each other such that when particular ones of the curved portions 19–22 faces the rollers 15*a*and 15*b*, the former presses against the latter. Further, the rollers 15*a* and 15*b* and pressing member 43 are bodily movable in a direction perpendicular to the transport path 14. A fixing device, not shown, for fixing the pressing member 43 in a particular position includes an angle adjusting mechanism, not shown. This mechanism adjusts the angular position of the pressing member 43 such that shaft 18 is deviated from the position where the rollers 15***a* and 15*b* and any of the curved portion 19–22 contact by a distance L toward the upstream side in the direction of sheet transport.

In the above construction, either of the rollers 15*a* and 15*b* is used in matching relation to the direction of curl of the sheet 4. Specifically, as shown in FIG. 20A, when the sheet 4 has an upward curl, it is passed through between the roller 15*a* and the pressing member 43. As shown in FIG. 20A, when the sheet 4 has a downward curl, it is passed through between the roller 15*b* and the pressing member 43. This insures the removal of a curl with no regard to the direction of the curl. Moreover, the angle adjusting mechanism adjusts the angular position of the pressing member 43 such that the shaft 18 is located more on the upstream side than the position where one of the rollers 15*a* and 15*b* to be used and one of the curved portions 19–22 contact. In this condition, the flat portion 43*a* serves to guide the sheet 4 being driven toward the roller 15*a* or 15*b* and pressing member 43. The sheet 4 is, therefore, smoothly moved to the position where the roller 15*a* or 15*b* and one of the curved portions 19–22 contact without jamming the transport path 14.

In summary, it will be seen that the present invention provides a curl removing device having various unprecedented advantages, as follows. A pressing member is fixed in place with one of curved portions thereof pressing against an elastic roller, whereby the curl of a recording sheet being passed through between the pressing member and the curved portion is removed. Since the curved portions have different radii of curvature and selectively pressed against the elastic roller, the straightening operation can be effected in matching relation to the amount of curl. This prevents a recording sheet having a noticeable curl from failing to have the curl removed sufficiently and prevents a recording sheet whose curl is not noticeable from being curled in the other direction.

A drive section rotates the pressing member in response to curl information and fixes it in a particular position where one of the curved portions thereof presses against the elastic roller. This allows the curved portion which should contact the elastic roller to be changed with ease.

A curl detecting device determines the amount of curl of a recording sheet while a controller drives the drive section in response to the output of the curl detecting device. This insures the adequate replacement of the curved portion that matches the amount of curl, further promotes the sure removal of a curl, and simplifies the operation for pressing a substitute curved portion against the elastic roller.

The pressing member has a recess at the rear of each curved portion with respect to the direction of rotation, and a flat portion extending from the recess to another curved portion next to the above-mentioned curved portion. An elastic guide member is located downstream of the pressing member with respect to the intended direction of sheet transport and has the free edge thereof abutting the flat portion adjoining the recess which it faces. Hence, a recording sheet being passed through between the elastic roller and the pressing member is prevented from jamming the transport path by being caught by the guide member. Moreover, a rotation limiting device allows the pressing member to rotate only toward the upstream side with respect to the direction of sheet transport. This prevents the pressing member from being reversed to damage the guide member. In addition, the flat portion serves to guide the sheet being transported to between the pressing member and the elastic roller, insuring the smooth transport of the sheet.

A one-way clutch is mounted on the shaft of the pressing member to play the role of the rotation limiting device. This is successful in surely preventing the pressing member from being reversed, despite the simple structure.

The rotation limiting device drives the pressing member in response to the output of the curl detecting device. Therefore, the pressing member is automatically rotated a position where an adequate curved portion thereof contacts on the basis of the amount of a curl. At the same time, the pressing member is prevented from being reversed.

A cleaning member is held in contact with the periphery of the pressing member. A rotation controller rotates the pressing member after a predetermined number of recordings have been produced. Then, the cleaning member removes toner particles and paper dust from the pressing member while freeing recordings from smears.

A substance that reduces surface energy is provided on the surface of the pressing member to reduce the deposition of toner particles and paper dust on the pressing member and to further enhance the removal by the cleaning member.

Nearby curved portions of the pressing member are connected to each other by a flat portion, and the center of rotation of the pressing member is positioned more on the upstream side than the position where the elastic roller and the curved portion contact. The flat portion, therefore, guides a recording sheet smoothly to between the elastic roller and the curved portion.

A pair of elastic rollers are positioned at opposite sides of the pressing member. The angular position of the pressing member is adjustable such that the center of rotation of the pressing member is located more on the upstream side than the position where the elastic roller to be used and the associated curved portion contact. In this configuration, the flat portion of the pressing member associated with one of the elastic rollers to be used serves to guide a recording sheet smoothly to between the elastic roller and the curved portion.

Various modifications will become possible for those skilled in the art after receiving the teachings of the present disclosure without departing from the scope thereof.

What is claimed is:

1. A device incorporated in an image recorder for removing the curl of a recording sheet, comprising:

a rotatable elastic roller disposed on a transport path defined in said image recorder for transporting the recording sheet, said elastic roller being located at the inner side with respect to the direction of the curl of said recording sheet;

a rotatable pressing member having a center of rotation parellel to the center of rotation of said elastic roller and located at the outer side with respect to the direction of the curl, said pressing member having a polygonal cross-section and a plurality of curved portions each having a particular radius of curvature on the periphery thereof; and fixing means for fixing said pressing member in a position where any one of said curved portions presses against the periphery of said elastic roller.

2. A device as claimed in claim 1, further comprising drive means for rotating said pressing means in response to curl information associated with the recording sheet and fixing said pressing member in a position where any one of said curved portions presses against the periphery of said elastic roller.

3. A device as claimed in claim 2, further comprising curl detecting means for determining the amount of curl of the recording sheet, and control means for driving said drive means in response to the output of said curl detecting means.

4. A device as claimed in claim 1, further comprising a cleaning member held in contact with the peripehery of said pressing member, and rotation control means for rotating said pressing means after a predetermined number of recording sheets have undergone a recording procedure.

5. A device as claimed in claim 4, wherein a substance which reduces surface energy is provided on the periphery of said pressing member.

6. A device as claimed in claim 1, further comprising rotation limiting means for causing said pressing member to rotate only toward the upstream side with respect to the intended direction of sheet transport;

said pressing member comprising a recess located at the rear of each of said curved portions with respect to the direction of rotation, and a flat portion extending from said recess to another curved portion next to said curved portion;

said device further comprising an elastic plate located downstream of said pressing member with respect to the intended direction of sheet transport and having the free end thereof held in contact with associated one of said flat portions of said pressing member in the vicinity of said recess.

7. A device as claimed in claim 6, wherein said rotation limiting means comprises a one-way clutch mounted on a rotatable shaft on which said pressing member is mounted.

8. A device as claimed in claim 6, further comprising curl detecting means for determining the amount of curl of the recording sheet, and rotation limiting means for causing said pressing member to rotate in response to the output of said curl detecting means.

9. A device incorporated in an image recorder for removing the curl of a recording sheet, comprising:

a rotatable elastic roller disposed on a transport path defined in said image recorder for transporting the recording sheet, said elastic roller being located at the inner side with respect to the curl of said recording sheet;

a rotatable pressing member having a center of rotation parellel to the center of rotation of said roller and located at the outer side with respect to the direction of the curl, said pressing member having a polygonal cross-section and a plurality of curved portions each having a particular radius of curvature on the periphery thereof; and fixing means for fixing said pressing member in a position where any one of said curved portions presses against the periphery of said elastic roller;

said center of rotation of said pressing member being deviated from the position where one of said curved portions presses against said elastic roller toward the upstream side with respect to the intended direction of sheet transport.

* * * * *